US007312412B2

(12) United States Patent
Cravey et al.

(10) Patent No.: US 7,312,412 B2
(45) Date of Patent: Dec. 25, 2007

(54) HIGH POWER LIQUID DIELECTRIC SWITCH

(75) Inventors: William Ray Cravey, Albuquerque, NM (US); Randy D. Curry, Columbia, MO (US); Kenneth Fox McDonald, Columbia, MO (US); Glenn A. Anderson, St. Charles, MO (US)

(73) Assignees: Alpha-Omega Power Technologies, Albuquerque, NM (US); The Curators of the University of Missouri, Columbia, MO (US); The Boeing Company, Chicago, IL (US)

( * ) Notice: Subject to any disclaimer, the term of this patent is extended or adjusted under 35 U.S.C. 154(b) by 677 days.

(21) Appl. No.: 10/870,381

(22) Filed: Jun. 17, 2004

(65) Prior Publication Data

US 2005/0023903 A1 Feb. 3, 2005

Related U.S. Application Data

(60) Provisional application No. 60/479,405, filed on Jun. 17, 2003.

(51) Int. Cl.
*H01H 35/24* (2006.01)
*H01H 33/00* (2006.01)
*B02B 1/24* (2006.01)

(52) U.S. Cl. ..... 200/81 R; 218/91; 307/112

(58) Field of Classification Search ..... None
See application file for complete search history.

(56) References Cited

U.S. PATENT DOCUMENTS 5,235,905 A * 8/1993 Bushnell et al. ..... 99/451

OTHER PUBLICATIONS

Curry, Randy D., et al., "The Development and Testing of Subnanosecond-Rise, Kilohertz Oil Switches for the Generation of High-Frequency Impulses", *IEEE Transactions on Plasma Science*, vol. 20 No. 3, (Jun. 1992),383-392.
Kattan, R. , et al., "Formation of Vapor Bubbles in Non-polar Liquids Initiated by Current Pulses", *IEEE Transactions on Electrical Insulation*, vol. 26, No. 4, (Aug. 1991),656-662.

* cited by examiner

*Primary Examiner*—Scott B. Geyer
*Assistant Examiner*—Seahvosh Nikmanesh
(74) *Attorney, Agent, or Firm*—Deborah A. Peacock; Philip D. Askenazy; Peacock Myers, P.C.

(57) ABSTRACT

Method and apparatus for switching high power at high repetition rates. The apparatus is preferably a switch utilizing a pressurized flowing dielectric. The pressurized dielectric suppresses growth of dielectric breakdown byproducts, such as large bubbles and breakdown contamination, enabling lower dielectric flow rates to remove the byproducts. In addition to the advantage of lower flow rates, and thus smaller and lighter pumping means, the switch can switch high energies (up to megajoules) at fast repetition rates, up to thousands of pulses per second.

60 Claims, 4 Drawing Sheets

HIGH POWER LIQUID DIELECTRIC SWITCH

CROSS-REFERENCE TO RELATED APPLICATIONS

This application claims the benefit of the filing of U.S. Provisional Patent Application Ser. No. 60/479,405, entitled "Development of High Power, High Pressure, Rep-Rate, Liquid Dielectric Switches," filed on Jun. 17, 2003, and the specification thereof is incorporated herein by reference.

GOVERNMENT RIGHTS

The U.S. Government has a paid-up license in this invention and the right in limited circumstances to require the patent owner to license others on reasonable terms as provided for by the terms of United States Air Force, Air Force Research Lab under Contract No. USAF F33615-01-C-2191.

BACKGROUND OF THE INVENTION

1. Field of the Invention (Technical Field)

The present invention relates to a high power electric switch which has an ultra short rise time and can be fired at a repetition rate from less than a pulse per second to more than 20,000 pulses per second and can switch joules to megajoules of energy per pulse with switch rise times of less than a nanosecond, yet switch pulse widths ranging from picoseconds to milliseconds.

2. Background Art

Note that the following discussion is given for more complete background of the scientific principles and is not to be construed as an admission that such concepts are prior art for patentability determination purposes.

Large scale pulse power systems, such as accelerators, fusion accelerators, medical accelerators, high power microwave systems, and other high voltage or pulse power systems require the switching of very high power (megawatt) loads, for example from one Joule to megajoules per pulse, and high repetition rates, for example from less than one pulse per second to 20,000 pulses per second. Pressurized flowing dielectric switches which can switch several hundred kilovolts are known in the art. However, such switches which operate at or near atmospheric pressure require substantial dielectric flow rates of 10-1000 liters per second (l/sec) when they are used to switch multikilojoule pulses. In 1992, subnanosecond rise time, kilohertz rep-rate oil switches were built and demonstrated that could operate at up to 290 kV at 200 pps and at 170 kV with a rep-rate of 1000 pps. The demonstrated rise time into a 97Ω resistive load was 280 ps. The modulator system, which utilized near atmospheric medium pressure oil switches, transferred a peak energy of 50 J per pulse (R. Curry et al., "The Development and Testing of Subnanosecond-Rise, Kilohertz Oil Switches for The Generation of High-Frequency Impulses", *IEEE Transactions on Plasma Science*, Vol. 20, No. 3, June 1992, pp. 383-392, incorporated herein by reference). These oil switches utilized transformer oil at pressures ranging from 1 atmosphere up to 100 psig. The flow rate geometries used in the switches included cross flow, or axial flow in switches that had a near uniform and enhanced electrode geometry. However, these switches were unable to switch kilojoules of energy for they were limited by residual bubbles at a flow rate of 1.6-7.57 l/sec at a repetition rate of over 100 pulses per second (pps).

When a high voltage pulse is applied to a flowing dielectric switch, once the switch breakdown voltage is reached, a streamer is launched and subsequent avalanche ionization and breakdown of the dielectric results. The arc then ionizes the dielectric medium and a gas bubble is formed between the electrodes. As the hydraulic or hydrostatic pressure is increased, the bubble size decreases. It is known that above a critical pressure for certain liquids, no bubbles are formed by charge injection (R. Kattan et al., "Formation of Vapor Bubbles in Non-polar Liquids Initiated by Current Pulses", *IEEE Transactions on Electrical Insulation* Vol. 26, No. 4, August 1991, pp 656-662, incorporated herein by reference). However, below a given operating or critical pressure the diameter of the bubble expands well beyond the electrode separation distance. The gas bubble grows and subsequently collapses, oscillating, until it finally rapidly degenerates into both suspended micro-bubbles and discharge byproducts (principally hydrocarbons) that encompass a large volume, if not the entirety, of the switch housing and electrode region.

Liquid dielectric insulated switches cannot sustain high voltages when gas bubbles, dissolved gases, and hydrocarbon byproducts are present because arcing or pre-firing is uncontrollably self-initiated. This also prevents recovery of the switch if voltage were reapplied before the entire volume of liquid in the switch could be exchanged, thus reducing the required achievable repetition rate because of the enormous liquid flow rates that would otherwise be required. Consequently, the repetition rate attainable by present day low-pressure liquid dielectric switches which transfer 100J-1MJ is typically limited to much less than one pulse per second, thereby eliminating them from addressing the high average power requirements of many crucial applications. This phenomenon occurs in all known liquid dielectric media suitable for pulse power switching applications, including water, water—glycol solutions, transformer oil, polyalphaolefin (PAO), and other synthetic dielectrics.

Thus there is a need for a kilovolt to megavolt capable, multijoule to megajoule range high power switch with high repetition rate operation, minimized dielectric media flow volume requirements with maximized local flow velocity in the vicinity of the electrodes; minimized electrode erosion; and reduced byproduct formation. There is also need for a compact switch with reduced acoustic impulse and a reduced EMI signature, and with enhanced reliability due to the inhibition of the access and/or adherence of the discharge byproducts to the switch housing solid insulators. The ability of the switch to utilize fluids such as PAO or other synthetic or natural dielectrics that are compatible with existing airframe and aerospace systems is a major advantage, allowing the switch to be integrated with an existing airframe hydraulic system, thereby reducing the volume of support equipment required for directed energy systems.

SUMMARY OF THE INVENTION (DISCLOSURE OF THE INVENTION)

The present invention is an electric switch comprising at least two electrodes and a flowing liquid dielectric having a pressure greater than approximately 100 psig, wherein the switch is capable of switching greater than approximately 1 joule, or preferably greater than approximately 50 joules, or more preferably greater than approximately one kilojoule, or most preferably greater than approximately one megajoule. The switch is preferably capable of switching greater than approximately five kilovolts, or more preferably greater than approximately 50 kilovolts, or yet more preferably greater than approximately one megavolt, or most preferably greater than approximately 5 megavolts. The switch preferably has a repetition rate of greater than approximately one pulse per second (pps), or more preferably greater than approximately 10 pps, or even more preferably greater than approximately 100 pps, or yet more preferably greater than approximately 1000 pps, or most preferably greater than approximately 10,000 pps. The dielectric preferably has a flow rate of less than approximately 100 liters per second, or more preferably less than approximately 20 liters per second, or even more preferably less than approximately 2 liters per second, or most preferably less than approximately 0.2 liters per second.

The dielectric is preferably de-aerated and preferably comprises a synthetic lubricant, optionally hydraulic fluid. The dielectric most preferably comprises polyalphaolefin (PAO). The distance between the at least two electrodes is preferably variable. Each electrode preferably has at least one opening which enables the dielectric to flow between an interior and exterior of each electrode. The dielectric preferably enters the switch cavity through the opening in a first electrode and exits the switch cavity through the opening in a second electrode. Each electrode is optionally substantially hemispherical. Alternatively, a first electrode is partially surrounded by a second electrode. The switch optionally comprises at least one cylindrical flow channel, which preferably provides a flow of the dielectric around the first electrode. The switch preferably comprises an outer coaxial return and a dielectric flow system. The dielectric flow system is optionally integrated with the switch, or alternatively comprises an airframe hydraulic system, or alternatively comprises a stand alone pump cart or system.

The invention is also a method for switching comprising the steps of providing at least two electrodes, pressurizing a liquid dielectric to a pressure greater than about 100 psig, flowing the liquid dielectric between the electrodes, inducing a voltage drop between the electrodes of at least a breakdown voltage of the dielectric, breaking down the dielectric between the electrodes, thereby providing an electrical path between the electrodes; and switching greater than approximately 1 joule. The breaking down step is preferably performed at a rate of at least approximately one pps, or more preferably at least approximately 10 pps, or even more preferably at least approximately 100 pps, or yet more preferably at least approximately 1000 pps, or most preferably at least approximately 10,000 pps. The dielectric flows at a rate of preferably less than approximately 100 liters per second, or more preferably less than approximately 20 liters per second, or even more preferably less than approximately 2 liters per second, or most preferably less than approximately 0.2 liters per second. The present method is for switching preferably greater than approximately 50 joules, or more preferably greater than approximately one kilojoule, or most preferably greater than approximately one megajoule. The method is also for switching preferably greater than approximately five kilovolts, or more preferably greater than approximately 50 kilovolts, or even more preferably greater than approximately one megavolt, or most preferably greater than approximately 5 megavolts.

The method preferably further comprises the step of de-aerating the dielectric, and preferably further comprises the step of varying a distance between the electrodes. The dielectric preferably flows out of a first opening in a first electrode and into a second opening in a second electrode. The method preferably further comprises the step of partially surrounding the first electrode with the second electrode, wherein the dielectric is preferably flowed around the first electrode. The method further preferably comprises the step of removing breakdown contamination, optionally comprising bubbles, from between the electrodes. The method further preferably comprises the step of lowering an inductance of a switch comprising the electrodes and the dielectric, preferably by partially surrounding the switch with an outer coaxial return.

An object of the present invention is to provide a high power switch capable of achieving high repetition rates.

An advantage of the switch of the present invention is its lower dielectric flow rate, which permits the use of a small, lightweight flow recirculating system, and increases the achievable repetition rate.

A further advantage is the compatibility of the present switch with existing hydraulic fluids and airframe hydraulic systems, thus optionally eliminating the need for a separate dielectric flow system.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

Figure 1:
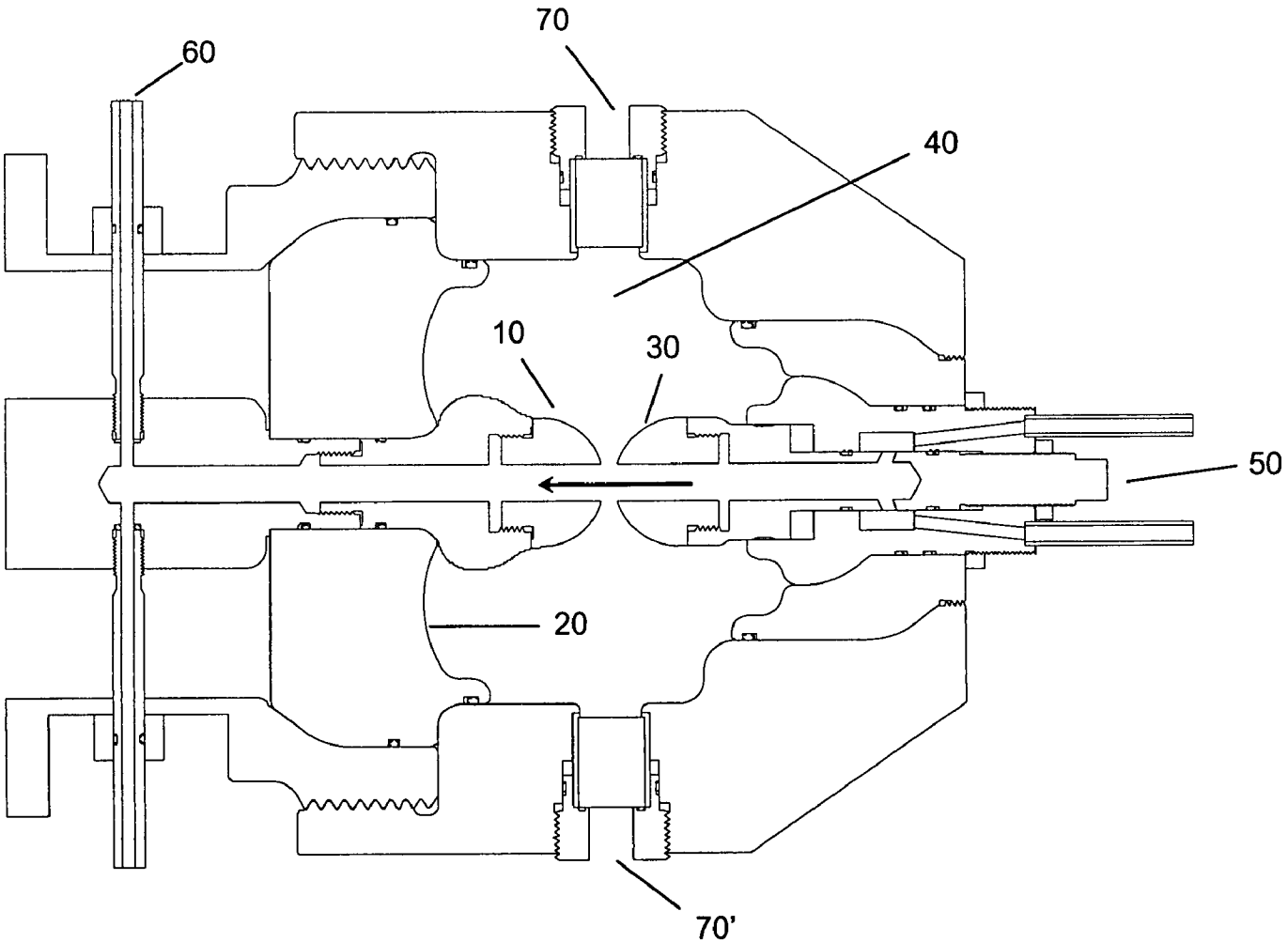
FIG. 1 is a cutaway view of an inline switch of the present invention.

DESCRIPTION OF THE PREFERRED EMBODIMENTS (BEST MODES FOR CARRYING OUT THE INVENTION)

The present invention is a liquid dielectric switch able to switch from hundreds of kilovolts to megavolts and thousands of kiloamperes, with discharge times ranging from a picosecond to a few milliseconds or less, operated at pressures ranging from 1 psig to 8000 psig.

As used throughout the specification and claims, "breakdown contamination" means discharge, carbon, hydrocarbon and/or electrode byproducts, byproducts, debris, debris cloud, bubbles, micro-bubbles, and the like.

The switch preferably uses liquid dielectric pressures on the order of about 10 psig, and more preferably about 50 psig, and more preferably about 100 psig, and most preferably about 1000 psig or more, thereby either preventing gas bubble formation or dramatically reducing bubble size, which enables rapid reabsorption of the bubbles by the fluid. Although a bubble of significant size is not generated at high enough pressures, a debris cloud containing discharge byproducts (principally carbon and electrode byproducts) expands from the discharge site and, if not removed, eventually fills a significant portion of the switch volume. However, pressurization minimizes this issue, reducing the volume of contaminated dielectric fluid, allowing the byproducts to be rapidly swept out of the inter-electrode gap with a minimum of flow and replacing them with fresh, uncontaminated flowing insulating dielectric material. That is, the velocity of the dielectric media flow in the vicinity of the electrodes easily exceeds the expansion velocity of the debris cloud, thus sweeping the debris away from the electrodes and into a field-free region prior to the next charge cycle. The combination of elimination of the large gas bubble expansion, reabsorption of the micro-bubbles, and a smaller debris cloud means a dramatically lower flow rate may be used. This enables a switch to recover in less time when operated above a threshold pressure, thus enabling higher repetition rates and higher power operation. In addition, use of the present invention is advantageous over the existing art even in low power and/or low repetition rate applications. This is because of the much lower dielectric flow rate required to sweep bubbles and debris out from between the electrodes. Not only is this easier to implement, but also it enables the use of smaller, lower power, and lower weight pumps, which is especially advantageous for aerospace applications.

Operation of the switch of the present invention at high pressures preferably results in undersaturation of the flowing dielectric, providing an advantage over other switches known in the art. For de-aerated, pressurized liquid dielectrics, the gas desorbed by the arc breaks up into microbubbles and then is partially reabsorbed into the liquid dielectric on a millisecond time scale. The amount of gas desorbed is also significantly less in undersaturated solutions, facilitating much quicker voltage recovery of the switch. In contrast, for prior art switches which operate at or near atmospheric pressure, the liquid dielectrics are normally saturated with gas, which greatly lengthens the reabsorption time of the desorbed gas, and thus the recovery time of the switch, thereby lowering the achievable repetition rate.

Several electrode geometries, including but not limited to axial electrodes or radial electrodes, may be employed to optimize the flow, discharge, and electrode erosion properties of the switch. One preferred embodiment, an inline switch with radial insulator, is depicted in FIG. 1. A high voltage pulse is applied to input electrode 10, which is preferably supported by high voltage insulator 20, which is preferably designed to operate at high voltage and high pressures simultaneously. An electric field is generated between the input electrode 10 and output electrode 30. Electrodes 10, 30 are preferably substantially hemispherical. Switch cavity 40 is filled with liquid dielectric at a pressure significantly higher than atmospheric pressure, preferably between about 1000 and 2000 psig. The electric field causes the liquid dielectric between input electrode 10 and output electrode 30 to break down, enabling current to flow between the electrodes, thereby closing the switch. The current flow and resulting plasma causes the high pressure dielectric to form debris comprising carbon and other byproducts between the electrodes. Flowing dielectric enters the switch through inlet 50, preferably flows through hollow electrodes 10, 30 in the direction indicated by the arrow, and exits the switch via outlet 60. The dielectric preferably flows through a recirculating system (not pictured), more fully described below. This flow sweeps the debris out from the center of the electrodes. The breakdown voltage of the switch is determined by the electrode spacing, which is preferably adjusted by moving output electrode 30. Output electrode 30 preferably comprises a threaded assembly to facilitate this adjustment. Sight ports 70, 70' are preferably used to view and/or record the breakdown process and clearing time of the debris.

Figure 2:
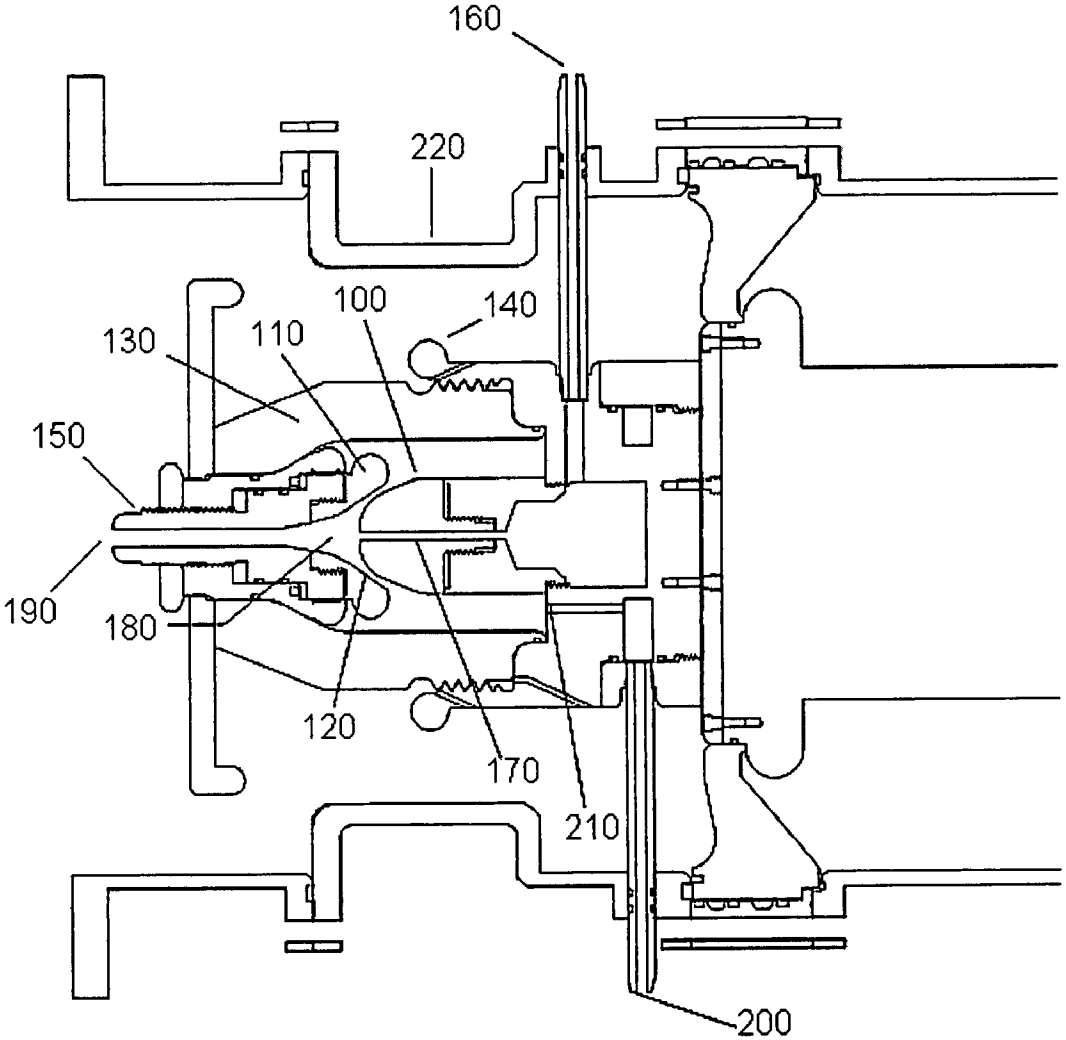
FIG. 2 is a cutaway view of a coaxial switch of the present invention.

FIG. 2 depicts a switch of the present invention having coaxial switch geometry. High voltage is applied to input electrode 100, which are preferably designed to be replaceable. Output electrode 110 is isolated from input electrode 100 by the high pressure liquid dielectric in breakdown region 120, which is preferably contained by annular high pressure insulator 130. One or more field shapers 140 are preferably used to control the electric field distribution across insulator 130. Gap adjuster 150 is preferably threaded and is preferably used to adjust the gap spacing between input electrode 100 and output electrode 110. Micro-bubbles and breakdown contaminants in the liquid dielectric formed by the conducting plasma, which occurs during breakdown of the dielectric, are swept out of breakdown region 120 by the flowing dielectric.

Multiple dielectric flow paths may be utilized. Axial flow dielectric preferably enters the switch through axial flow inlet 160 and enters cavity 180 through input electrode channel 170. Cylindrical flow dielectric optionally enters the switch through cylindrical flow inlet 200 and enters cavity 180 through cylindrical flow channel 210. A plurality, preferably twelve, of cylindrical flow inlets 200 and cylindrical flow channels 210, preferably circumferentially arranged around the switch, and preferably evenly spaced, may be employed. The cylindrically flowing dielectric facilitates the removal from breakdown region 120 of the carbon and other breakdown byproducts. Dielectric from cavity 180 exits the switch through output electrode 110 via dielectric outlet 190. The axial flow topology may optionally operate in a "jet pump" mode, whereby the axial flow dielectric from entering cavity 180 from channel 170 has a high enough flow rate so that the dielectric media surrounding the electrodes, optionally partly comprising dielectric entering cavity 180 from cylindrical flow channels 210, is "pulled" radially into gap cavity 180 and exits axially through outlet 190. In the jet pump mode the flow may be provided by the main dielectric pumping system or alternatively by a separate, smaller system used solely for pumping the axial flow dielectric.

Fast switching times are accomplished preferably by utilizing outer coaxial return 220, which is substantially cylindrically disposed about the switch, thereby reducing the overall inductance of the switch. Outer coaxial return 220 is preferably connected via an electric load to the output electrode assembly.

As depicted in the above embodiments, the liquid dielectric media flow may enter the gap between the electrodes either radially or axially, or by a combination thereof, but preferably exits the gap axially in order to transport the discharge the byproduct debris cloud into the interior of the electrode, which is the nearest electric field-free region, prior to application of the next voltage pulse. The electrodes may be hollow or may optionally consist of machined electrodes that allow on axis flow and subsequent removal of the byproducts. Porous electrode surfaces may optionally be used to prevent boundary layers from forming.

In all embodiments of the present invention, the voltage breakdown of the system is preferably monitored in real time. In order to compensate for electrode erosion, the gap spacing of the electrodes is preferably adjusted to increase or decrease the breakdown voltage until the desired value is reached. The adjustment system preferably comprises a mechanical or electrical system, preferably comprising piezoelectric actuators, and optionally comprising a feedback system. The adjustment can alternatively be made manually. The electrodes preferably comprise a metal or other conducting material with low erosion rates, including but not limited to stainless steel, tungsten composites, tungsten-copper matrices, single crystal tungsten, and other synthetic materials that have a low erosion rate. Directed flow electrodes that allow the flow to be reduced and direct the byproducts into a field free region may alternatively be employed.

The flowing dielectric used in the high pressure switch of the present invention may comprise transformer oil, water, water-glycol mixtures, synthetic oils such as hydraulic fluid, or any other dielectric with desirable insulation characteristics which can be pressurized. Some transformer oils, which have been traditionally used for high voltage switches, are not compatible with high pressure, flowing pumping systems. Water and other natural or synthetic dielectrics also may freeze and require external heaters or separate pumping systems as well as additives such as antifreeze. The preferable use of synthetic lubricants in the present switch further enhances its capabilities because of these lubricants' greater voltage hold-off capability and reduced formation of byproducts. The tested performance of the synthetic fluids also increase the electric breakdown field of the switch allowing the electrode spacing to be reduced and lowering the inductance of the switch, the switch losses and the flow rate due to the reduced volume of liquid between the electrodes.

A preferred synthetic oil is polyalphaolefin (PAO), which has a higher flashpoint, is compatible with current airframe systems, and has a superior viscosity than that of transformer oil. The measured breakdown voltage, 1.1-1.25 MV/cm, of de-aerated PAO was found to be comparable or superior to that of transformer oils operated at pressures in the range of 1000-2000 psig. For various pulse charge times the breakdown field may be in the range of 200 kV/cm up to 10 MV/cm. The utilization of flowing dielectrics that are compatible with existing airframe and aerospace hydraulic systems (that is, fluids that are currently used as hydraulic fluid in airframe systems), including but not limited to PAO, is a novel aspect of the present invention. Such fluids have not been used as dielectrics in the past. The PAO solution both lubricates the hydraulic system and provides the dielectric strength required to hold off voltage and achieve the low inductance required by directed energy systems. In certain applications the switch may be directly integrated with the airframe hydraulic system, thus eliminating the need for a separate dielectric flow system, along with its attendant weight, complexity, and cost.

The switch or the present invention preferably utilizes electrode configurations which permit the control of the location of the discharge and the ability to move the discharge location to different areas on the electrode surface, thereby minimizing localized electrode erosion. These electrode configurations are also preferably optimized to minimize global dielectric media flow volume requirements while maximizing the flow velocity in the critical area of the electrodes, thereby rapidly sweeping the discharge byproducts into a field free region.

The switch also preferably comprises an integrated flow system and preferably utilizes a design prohibiting discharge byproducts from accessing and adhering to the switch housing solid insulators. The switch preferably is operated with a hydraulic recirculating dielectric media flow system, preferably comprising a pump for pressurization of the system and a reservoir. The pump may comprise an onboard hydraulic pump; alternatively an actuator may be used to pressurize the switch. The flow system preferably comprises one or more accumulators and particulate filters, which actively filter out carbon particle byproducts, including but not limited to micron sized particles, and allow continuous flow of the dielectric through the switch. The filters preferably include a particulate filter and/or a coalescing filter for removal of water and/or particles as desired. During normal operation of the switch, gases are introduced into the liquid dielectric by the arc and the subsequent arc byproducts. Therefore the liquid dielectric should preferably be de-aerated prior to and during operation of the switch. A de-aeration system, comprising one or more de-aeration stages, which consists of a vacuum pump and a reservoir is therefore preferably integrated into the pumping system. In one embodiment, the flow is preferably pulsed on and off to reduce the power required for the hydraulic system. This recirculating system may be integrated with the switch, or alternatively comprises either an existing on-board hydraulic system, such as that employed on an aircraft, or a stand alone pump cart or system.

In pulsed power systems a triggered switch may be required, whereby a high voltage or trigger pulse is applied to the switch and the switch self-breaks upon command. The switch may be triggered by application of a high voltage trigger pulse, a laser pulse, a microwave pulse or other means that results in the switch breaking down with low jitter. If an electrical pulse is used to trigger the switch the switch may incorporate a midplane or a third electrode, as in a trigatron. The high voltage electrical pulse starts streamers in the gap and introduces UV radiation and an electron avalanche which triggers the switch. Alternatively the switch may be triggered with a laser pulse, microwave pulse, or other means that introduces UV, electron avalanches or bubbles into the electrode gap and triggers the switch. In this embodiment the gas bubble introduced into the electrode gap provides a dielectric mismatch and an ionization path in the high electric field which exists in the gap between the electrodes. The initiation of the avalanche and subsequent ionization of the dielectric triggers the switch.

EXAMPLE 1

A test stand comprising a switch of the present invention was constructed that has an output impedance of 4.4Ω and produces a 70 ns pulse. The switch was designed for the following requirements: switched voltage: 250-1000 kV; current: 50-250 kA; risetime: <50 ns; charge transfer: ~0.5 Coulombs/pulse; switched energy: 250-1000 Joules per pulse; pressure: up to 3000 psig; jitter: <<50 ns; repetition rate: 50-150 pps; pulse width (duration): 50-500 ns; and lifetime: $10^7$-$10^8$ pulses. These parameters were chosen because these are the requirements specified for potential directed energy systems.

Figure 3A:
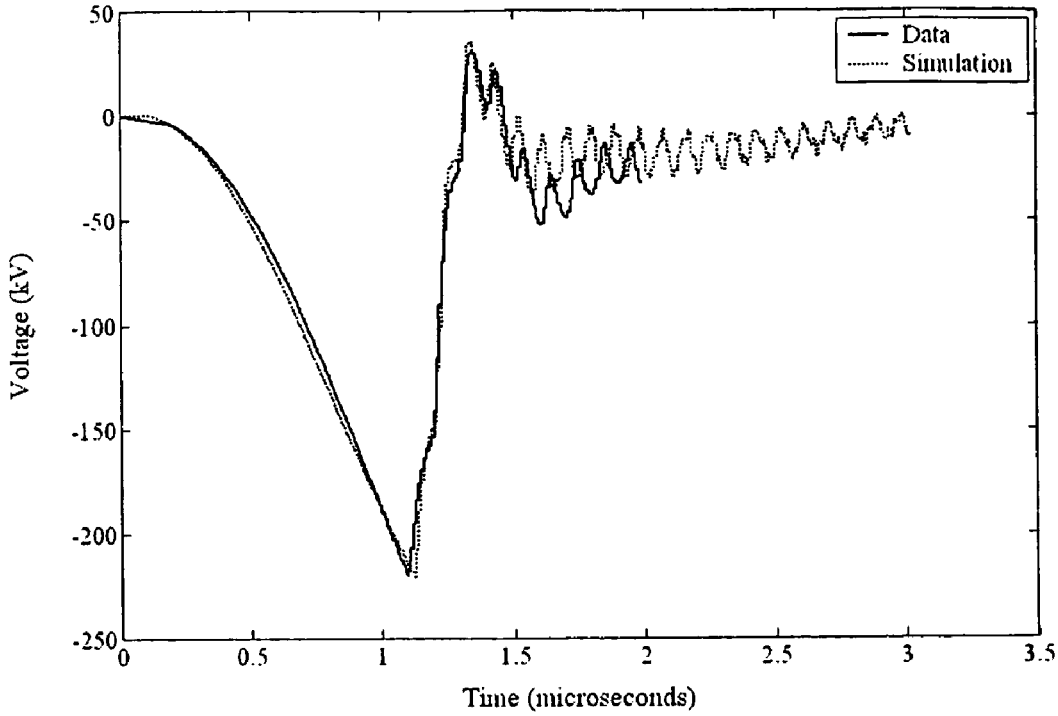
FIGS. 3A and 3B are graphs depicting experimental results showing the variation of switching voltage and carbon byproduct region size with time according to Example 1 of the present invention.

The switch incorporated adjustable electrodes, allowing the electrode separation to be adjusted from 0.1 to 1 cm. Optical viewports were also integrated with the design allowing both the framing and high speed camera diagnostics to be integrated into the test stand, for characterization of bubble formation and byproduct expansion velocity. The single shot switch of the present example typically switched a 100 ns, 270-325 kV, 100 kA pulse into a 1.6Ω load, with an energy per pulse delivered to the load of approximately 1 kJ. A graph of switching voltage vs. time for one experiment is shown in FIG. 3A. Both transformer oil and synthetic lubricants, such as PAO, were used in the experiments. For a 0.2 cm electrode gap the calculated arc inductance of the switch was 3 nH (15 nH/cm×0.2 cm). For a 1.6Ω discharge load the 10-90% inductive rise time of the switch was 3.8 ns, while the calculated 10-90% risetime of the switch was 10-11 ns, which is an order of magnitude less than the risetime for the rest of the circuit (thus the switch was not the limiting factor). The electrodes comprised a copper tungsten composite (K3); however, any conductive material may be used. The electrodes had a diameter of 3.81 cm (1.5 inches), although other sizes and/or shapes may be used.

Figure 3B:
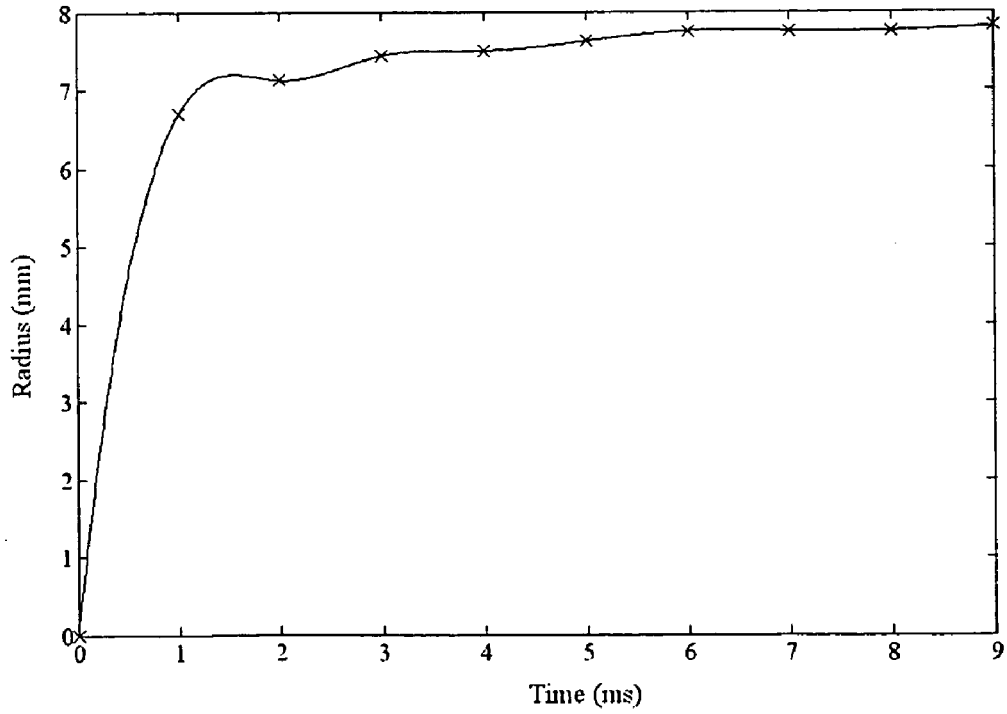

High speed optical diagnostics were used to observe the formation of bubbles and other byproducts. FIG. 3B graphs the radius of the region containing carbon byproducts vs. time after pulse at 2000 psig, showing that this region expands rapidly for about the first two milliseconds, with a modest expansion velocity of about 12.5 cm/s after that. This indicates that a 300 kV switch for use at or near this pressure, which can switch kilojoules of energy per pulse with a repetition rate of 100 pps, requires only a modest flow rate of 1-2 l/sec, which is almost a factor of 10 reduction from the atmospheric pressure switches known in the prior art. Concurrently the rise time of such a switch pulse charged in 1-1.2 microseconds will have a rise time of 10-11 nanoseconds or less, and allow kilojoules per pulse to be transferred at 100-200 pps. In addition, high speed photography showed that the bubbles and byproducts were swept out of the inter-electrode region in a short enough time to enable a repetition rate of at least hundreds of pulses per second. Thus the technology is scaleable to the goal of 1 MV and 100 pps operation, since only a modest 3-7 l/sec flow-rate will be required for such a switch.

Figure 4A:
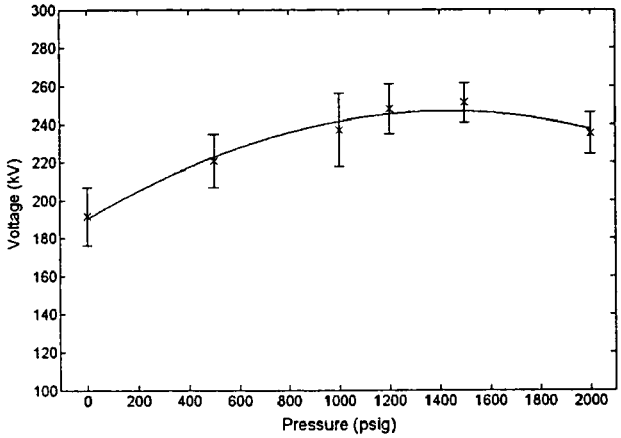
FIGS. 4A-4C are graphs depicting experimental results showing the variation of breakdown voltage, maximum bubble radius, and bubble oscillation period with pressure according to Example 1 of the present invention.
Figure 4B:
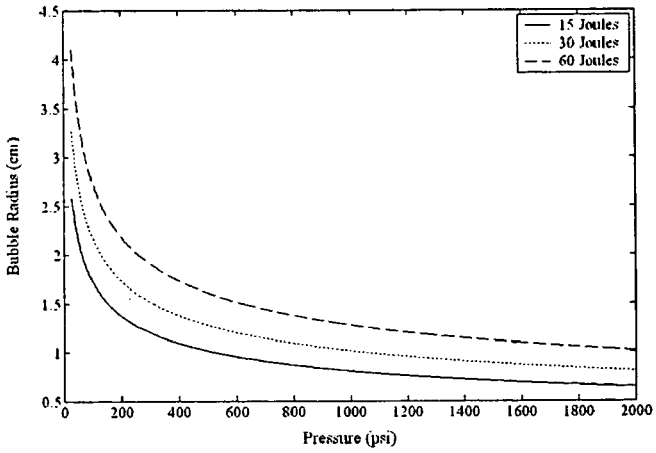
Figure 4C:
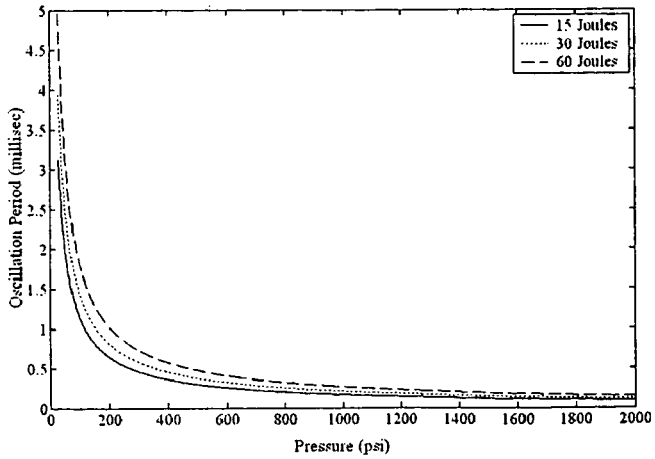

Experiments were conducted from atmospheric pressure up to 13.8 MPa (2000 psig). The voltage breakdown of the switch versus pressure, for a 0.2 cm electrode gap, is shown in FIG. 4A. The data correspond to a breakdown electric field varying between 1.1-1.25 MV/cm. Each data point represents the statistical average of ten breakdowns using unconditioned electrodes. The variation, about ±10%, decreased to about ±6.5% after conditioning of the electrodes. The error bars represent one standard deviation for each data set at the test pressure. The curve fit shown is a second order polynomial least squares approximation. The data shown in FIG. 4A indicate that the breakdown strength increases by 25-30% from atmospheric pressure to 10.3 MPa (1500 psig). Thus the use of high pressures increases the switching voltage, in agreement with earlier experiments. In addition, there is indicated an optimal pressure for which maximum voltage breakdown occurs. The maximum bubble radius and bubble oscillation period vs. pressure are shown in FIGS. 4B and 4C, clearly demonstrating the advantage of operating the switch at high pressures.

The preceding example can be repeated with similar success by substituting the generically or specifically described operating conditions of this invention for those used in the preceding components.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. An electric switch comprising:

at least two electrodes; and a flowing liquid dielectric having a pressure greater than approximately 100 psig;

wherein said switch is capable of switching greater than approximately 1 joule.

2. The electric switch of claim 1 having a repetition rate of greater than approximately one pulse per second (pps).

3. The electric switch of claim 2 having a repetition rate of greater than approximately 10 pps.

4. The electric switch of claim 3 having a repetition rate of greater than approximately 100 pps.

5. The electric switch of claim 4 having a repetition rate of greater than approximately 1000 pps.

6. The electric switch of claim 5 having a repetition rate of greater than approximately 10,000 pps.

7. The electric switch of claim 1 wherein said dielectric has a flow rate of less than approximately 100 liters per second.

8. The electric switch of claim 7 wherein said dielectric has a flow rate of less than approximately 20 liters per second.

9. The electric switch of claim 8 wherein said dielectric has a flow rate of less than approximately 2 liters per second.

10. The electric switch of claim 9 wherein said dielectric has a flow rate of less than approximately 0.2 liters per second.

11. The electric switch of claim 1 capable of switching greater than approximately 50 joules.

12. The electric switch of claim 11 capable of switching greater than approximately one kilojoule.

13. The electric switch of claim 12 capable of switching greater than approximately one megajoule.

14. The electric switch of claim 1 capable of switching greater than approximately five kilovolts.

15. The electric switch of claim 14 capable of switching greater than approximately 50 kilovolts.

16. The electric switch of claim 15 capable of switching greater than approximately one megavolt.

17. The electric switch of claim 16 capable of switching greater than approximately 5 megavolts.

18. The electric switch of claim 1 wherein said dielectric comprises a synthetic lubricant.

19. The electric switch of claim 18 wherein said synthetic lubricant comprises hydraulic fluid.

20. The electric switch of claim 19 wherein said hydraulic fluid comprises polyalphaolefin (PAO).

21. The electric switch of claim 1 wherein said dielectric is de-aerated.

22. The electric switch of claim 1 wherein a distance between said at least two electrodes is variable.

23. The electric switch of claim 1 wherein each of said at least two electrodes have at least one opening.

24. The electric switch of claim 23 wherein said at least one opening enables said dielectric to flow between an interior and exterior of each of said at least two electrodes.

25. The electric switch of claim 24 wherein said dielectric enters a switch cavity through said opening in a first said electrode and exits said switch cavity through said opening in a second said electrode.

26. The electric switch of claim 1 wherein each of said at least two electrodes is substantially hemispherical.

27. The electric switch of claim 1 wherein a first said electrode is partially surrounded by a second said electrode.

28. The electric switch of claim 27 further comprising at least one cylindrical flow channel.

29. The electric switch of claim 28 wherein said at least one cylindrical flow channel provides a flow of said dielectric around said first electrode.

30. The electric switch of claim 1 further comprising an outer coaxial return.

31. The electric switch of claim 1 further comprising a dielectric flow system.

32. The electric switch of claim 31 wherein said dielectric flow system is integrated with said switch.

33. The electric switch of claim 31 wherein said dielectric flow system comprises an airframe hydraulic system.

34. The electric switch of claim 31 wherein said dielectric flow system comprises a stand alone pump cart or system.

35. A method for switching comprising the steps of:

providing at least two electrodes;

pressurizing a liquid dielectric to a pressure greater than about 100 psig;

flowing the liquid dielectric between the electrodes;

inducing a voltage drop between the electrodes of at least a breakdown voltage of the dielectric;

breaking down the dielectric between the electrodes, thereby providing an electrical path between the electrodes; and switching greater than approximately 1 joule.

36. The method of claim 35 wherein the breaking down step is performed at a rate of at least approximately one pps.

37. The method of claim 36 wherein the breaking down step is performed at a rate of at least approximately 10 pps.

38. The method of claim 37 wherein the breaking down step is performed at a rate of at least approximately 100 pps.

39. The method of claim 38 wherein the breaking down step is performed at a rate of at least approximately 1000 pps.

40. The method of claim 39 wherein the breaking down step is performed at a rate of at least approximately 10,000 pps.

41. The method of claim 35 wherein the flowing step comprises flowing the dielectric at a rate of less than approximately 100 liters per second.

42. The method of claim 41 wherein the flowing step comprises flowing the dielectric at a rate of less than approximately 20 liters per second.

43. The method of claim 42 wherein the flowing step comprises flowing the dielectric at a rate of less than approximately 2 liters per second.

44. The method of claim 43 wherein the flowing step comprises flowing the dielectric at a rate of less than approximately 0.2 liters per second.

45. The method of claim 35 wherein the switching step comprises switching greater than approximately 50 joules.

46. The method of claim 45 wherein the switching step comprises switching greater than approximately one kilojoule.

47. The method of claim 46 wherein the switching step comprises switching greater than approximately one megajoule.

48. The method of claim 35 wherein the switching step comprises switching greater than approximately five kilovolts.

49. The method of claim 48 wherein the switching step comprises switching greater than approximately 50 kilovolts.

50. The method of claim 49 wherein the switching step comprises switching greater than approximately one megavolt.

51. The method of claim 50 wherein the switching step comprises switching greater than approximately 5 megavolts.

52. The method of claim 35 further comprising the step of de-aerating the dielectric.

53. The method of claim 35 further comprising the step of varying a distance between the electrodes.

54. The method of claim 35 wherein the flowing step comprises flowing the dielectric out of a first opening in a first electrode and into a second opening in a second electrode.

55. The method of claim 35 further comprising the step of partially surrounding a first electrode with a second electrode.

56. The method of claim 55 wherein the flowing step comprises flowing the dielectric around the first electrode.

57. The method of claim 35 further comprising the step of removing breakdown contamination from between the electrodes.

58. The method of claim 57 wherein the breakdown contamination comprises bubbles.

59. The method of claim 35 further comprising the step of lowering an inductance of a switch comprising the electrodes and the dielectric.

60. The method of claim 59 further comprising the step of at least partially surrounding the switch with an outer coaxial return.

* * * * *